US005313180A

United States Patent [19]

Vial et al.

[11] Patent Number: 5,313,180

[45] Date of Patent: May 17, 1994

[54] MOLDED CASE CIRCUIT BREAKER CONTACT

[75] Inventors: Denis Vial, Fontaine; Jean Bofils, Seyssins; Marc Rival, Panissage, all of France

[73] Assignee: Merlin Gerin, France

[21] Appl. No.: 26,300

[22] Filed: Mar. 4, 1993

[30] Foreign Application Priority Data

Mar. 13, 1992 [FR] France ..... 92 03141

[51] Int. Cl.[5] ..... H01H 75/00

[52] U.S. Cl. ..... 335/16; 335/147; 200/147 R

[58] Field of Search ..... 335/16, 147, 195; 200/147 R

[56] References Cited

U.S. PATENT DOCUMENTS

| | | | |
|---|---|---|---|
| 4,470,227 | 9/1984 | Link et al. | 335/16 |
| 4,910,485 | 3/1990 | Bolongeat-Mobleu et al. . | |
| 4,916,421 | 4/1990 | Pardini et al. | 335/185 |
| 5,029,301 | 7/1991 | Nebon et al. | 335/16 |

FOREIGN PATENT DOCUMENTS

| | | |
|---|---|---|
| 0028740 | 5/1981 | European Pat. Off. . |
| 0146033 | 6/1985 | European Pat. Off. . |
| 0314540 | 5/1989 | European Pat. Off. . |
| 1227978 | 11/1966 | Fed. Rep. of Germany . |
| 7145367 | 5/1973 | Fed. Rep. of Germany . |
| 559420 | 2/1975 | Switzerland . |

*Primary Examiner*—Lincoln Donovan

*Attorney, Agent, or Firm*—Parkhurst, Wendel & Rossi

[57] ABSTRACT

A movable contact bridge of a molded case limiting circuit breaker is supported by a bar by a system of springs enabling opening with electrodynamic repulsion. The contact bridge cooperates with stationary contacts rigidly secured to current input conductors in the shape of half-loops. An anvil is adjoined to the rear of the stationary contacts to increase the closing impact effect of the contact bridge and prevent contact resistance dispersions. The anvil is made of ferromagnetic material increase the magnetic field for blowout of the arc to the extinguishing chambers.

4 Claims, 5 Drawing Sheets

MOLDED CASE CIRCUIT BREAKER CONTACT

BACKGROUND OF THE INVENTION

The invention relates to a molded case low-voltage limiting circuit breaker comprising a rotary contact bridge, a pair of stationary contacts cooperating with said contact bridge, a conductor for current input to each of the stationary contacts extending in the plane of movement of the contact bridge and shaped to form with the contact bridge a looped trajectory to generate electrodynamic repelling forces, a bar having a transverse opening in which there is located the central part of the contact bridge with a freedom of rotation in the opening direction due to the action of the electrodynamic forces against an elastic force providing the contact pressure, the current input conductor being arranged as a half-loop having a first and a second parallel strand spaced apart, the first strand bearing a stationary contact part.

The current limiting effect by a circuit breaker of the kind referred to depends on the speed of opening of the contacts. Regardless of the operating mechanism, this speed of opening depends on the intensity of the electrodynamic repelling forces and on the weight of the mobile assembly, i.e. the contact bridge. The small weight of the mobile contact bridge presents an unfavorable effect on closing of the circuit breaker. The contact resistance, and therefore the temperature rise, is greater. Moreover, the dispersion of the contact resistances is much greater. Correct operation of the circuit breaker can be affected by these increased dispersion and resistance phenomena and object of the present invention is to enable an improved contact device to be achieved.

According to the document EP-A-28740, a magnetic circuit presents a transverse part having a small thickness with respect to the air-gap separating the central part from the bottom strand of the current input conductor. This part of the magnetic current presents a certain flexibility liable to give rise to bouncing of the movable contact on the stationary contact, when the weight of the movable contact is small.

According to the document DE-B-1,227,978, an insulating shim is inserted without clearance between the two strands of the current input conductor. This shim does not rest on any stop of the case.

SUMMARY

The circuit breaker according to the invention is characterized in that:

- an anvil formed by a rigid metal block is inserted between the two strands of the current input conductor, being adjoined to the first strand opposite from the stationary contact part, and forming an air-gap with the other strand,
- grooves provided in the side walls of the case act as support surfaces for the anvil, which is rigidly secured to the case,
- the end of the first strand is free and is held by the anvil,
- and the metal block of the anvil is made of ferromagnetic material to strengthen the magnetic field for arc blowout to the extinguishing chamber.

The favorable action of the anvil can be explained by an absence of contact bounce upon closing thereby achieving a more efficient impact between the contacts for crushing of the contact surfaces. In state-of-the-art circuit breakers, the weight of the mobile assembly is sufficiently great to strike the movable contact hard against the stationary contact and thus achieve crushing of the contact surface and a low contact resistance. The same result is obtained according to the present invention for a contact bridge of small weight by adjoining an anvil to the stationary contact.

The presence of the anvil provides the stationary contact with a stable support, formed by the contact part and the conductor strand for current input to the anvil. The anvil is preferably made of ferromagnetic material to prevent Foucault currents liable to generate an additional temperature rise.

The invention is described in detail in its preferred application to a limiting circuit breaker of the type described in French Patent application no. 91 12793 filed on Oct. 15, 1991, in which the contact bridge is mounted floating in the operating bar. It is clear that the anvil contact system is applicable to other molded case circuit breakers.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
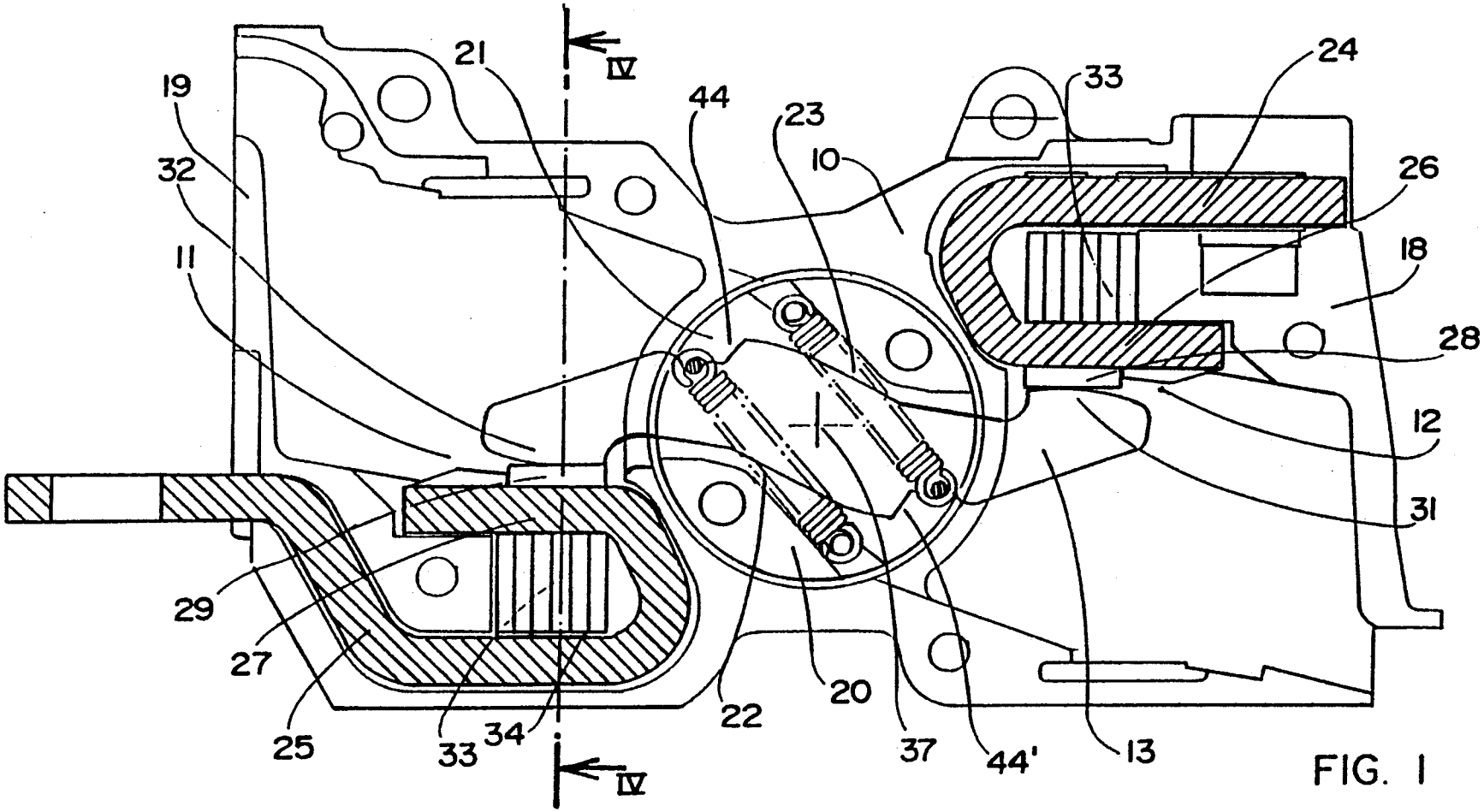
FIG. 1 is a schematic view of the contacts of a pole of a circuit breaker according to the invention, represented in the closed position.
Figure 2:
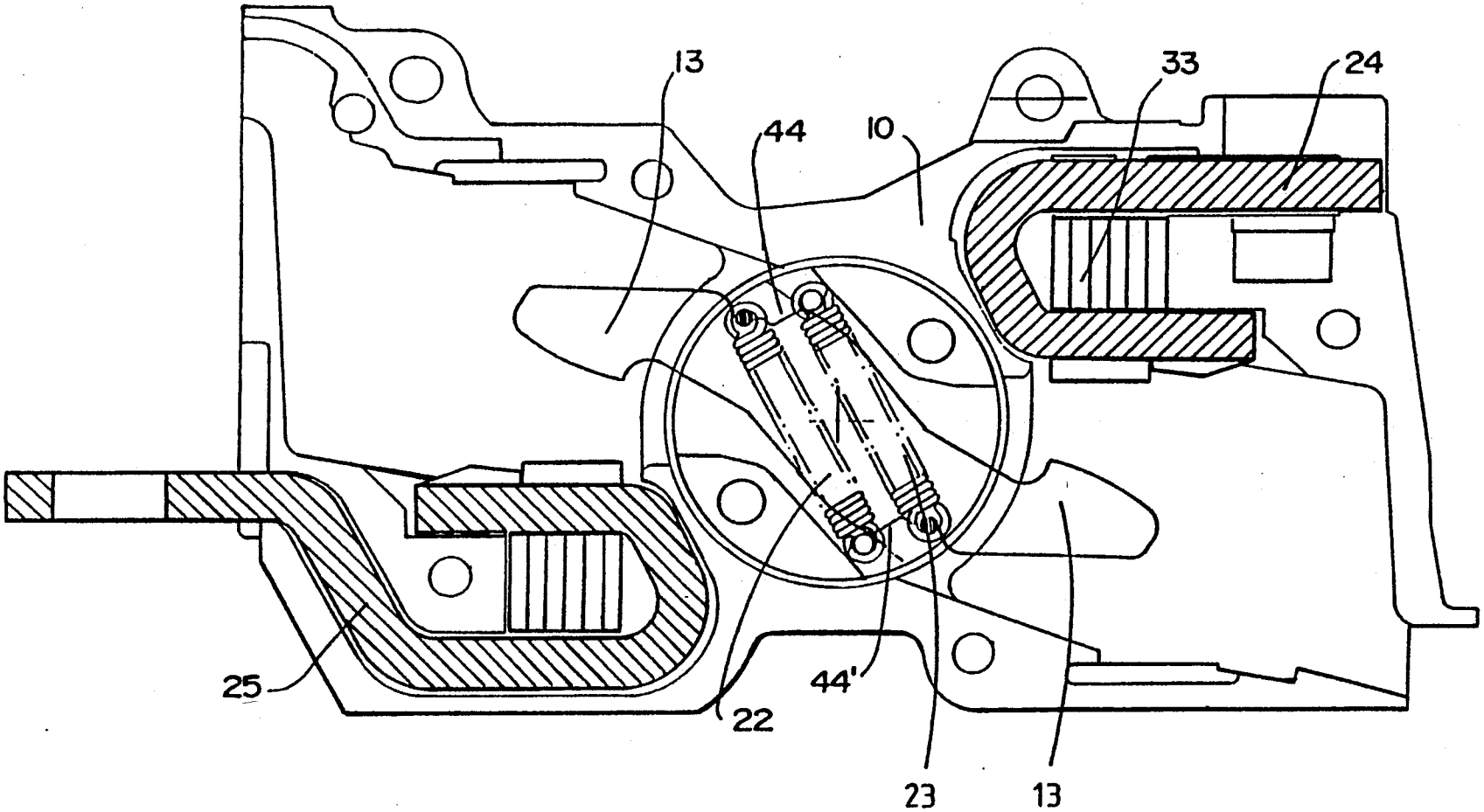
FIG. 2 is a similar view to that of FIG. 1 showing the contacts in the course of opening.
Figure 3:
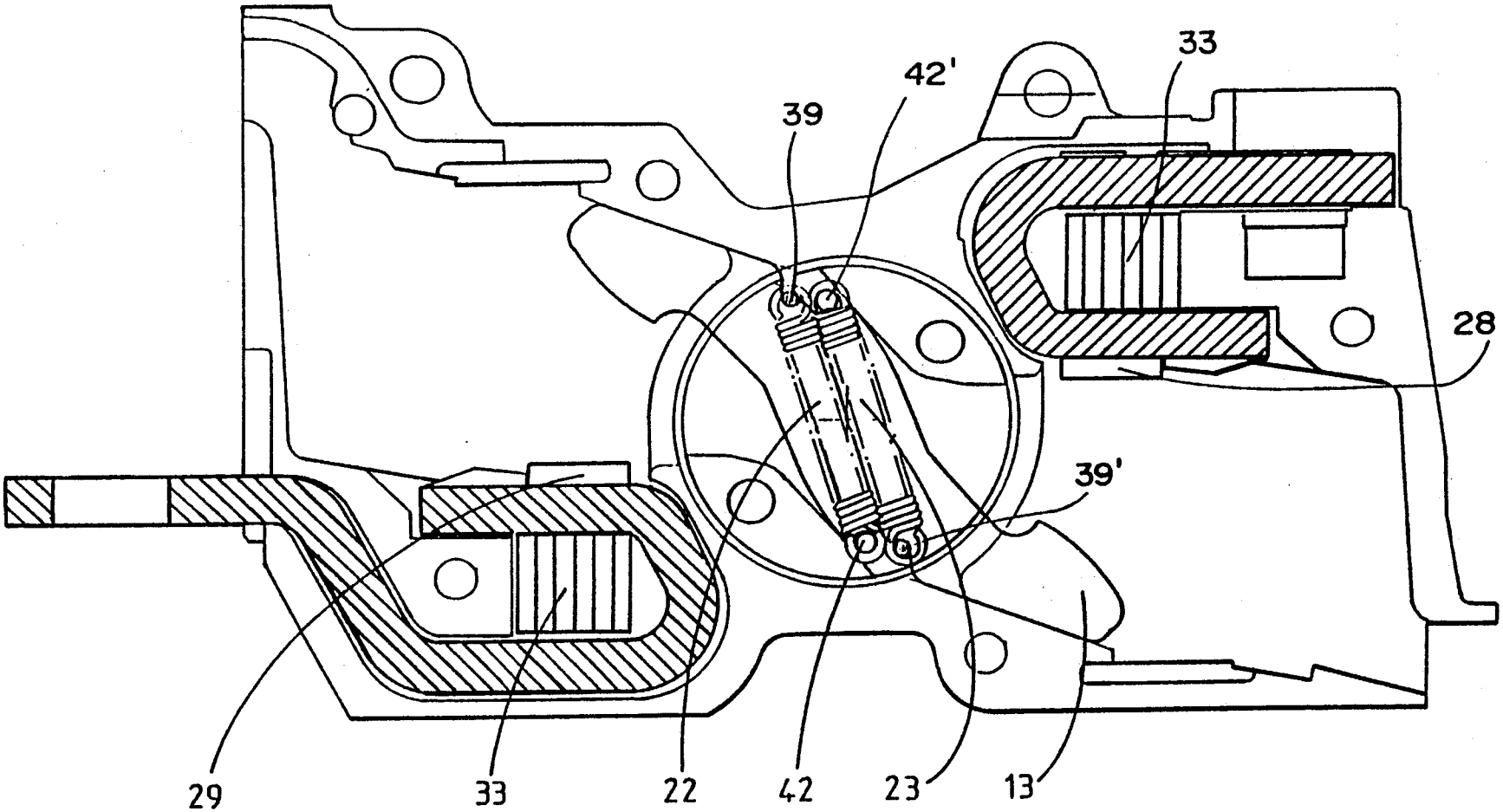
FIG. 3 is a similar view to that of FIG. 1 showing the contacts in the open position.
Figure 4:
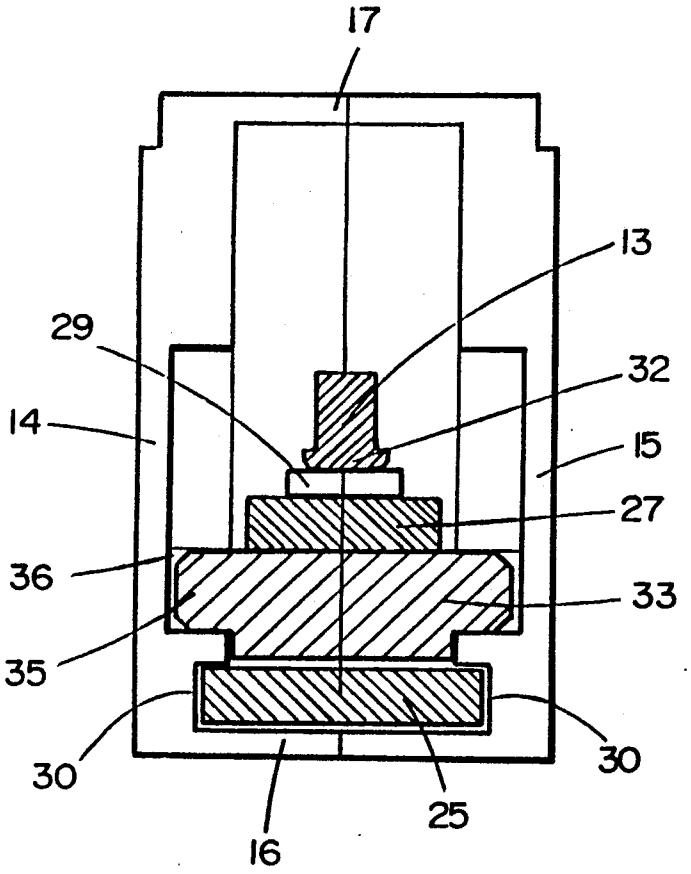
FIG. 4 is a cross-section along the line IV—IV of FIG. 1.

In the drawings, a case 10, made of plastic insulating material, contains the breaking elements of a pole of a molded case limiting circuit breaker, including a pair of stationary contacts 11, 12 and a movable contact bridge 13, and two arc extinguishing chambers which are not represented. The case 10 of general parallelipipedic shape is formed by two large side panels 14, 15, a base plate 16 and a top plate 17, and two small side panels 18, 19. The movable contact bridge 13 is supported by a rotating bar section 20, inserted between the two large side panels 14, 15. The bar section 20 presents an orifice 21 which extends according to a diameter in a direction parallel to the large side panels and the contact bridge 13 passes through this orifice with clearance protruding out from each side of the bar section 20. The contact bridge 13 is mounted floating on the bar section 20 by two pairs of springs 22, 23, in the manner described in detail hereinafter. Two current input conductors 24, 25 pass through the small end panels, respectively 18, 19, and are extended inside the case 10 by a curved part in the form of a half-loop whose end 26, 27 bears the associated stationary contact part 28, 29. In the closed position of the contact bridge 13, the stationary contact part 28 cooperates with the movable contact 31 supported by the contact bridge 13, whereas the stationary contact part 29 cooperates with the movable contact 32. The current input at a given moment via the input conductor 24 flows through the closed contacts 28, 31, contact bridge 13, and closed contacts 32, 29, and is output on the opposite side via the conductor 25. It can be seen that the ends 26, 27 have flowing in them currents of opposite polarities to the currents flowing in the contact bridge 13, giving rise to a repelling force moving the contact bridge 13 to the open position. This looped trajectory in the zone of the contacts 28, 31; 29, 32 generates a magnetic field for arc blowout in the direction of the extinguishing chambers. An operating mechanism (not represented) is coupled to the bar section 20 to control its rotation and thereby opening and closing of the contacts 28, 31; 29, 32. A circuit breaker of this kind is described in detail in the above-mentioned French Patent application no. 91 12793 which should advantageously be referred to for further details.

The parts of the current input conductors 24, 25 internal to the case 10 are appreciably symmetrical and only the arrangement of input conductor 25 is described in detail hereafter, that of input conductor 24 being identical. The input conductor 25 adjoined to the base plate 16 is engaged laterally in the notches 30 arranged in the two large side panels 14, 15. The width of the flat conductor 25 is reduced in the curved zone and at its end 27, arranging a clearance between the conductor and the large side panels 14, 15. An anvil 33, formed by a rigid metal block, is fitted between the two branches of the half-loop of the conductor 25, being adjoined to the face of the end 27 opposite from the one bearing the stationary contact 29. The anvil 33 is rigidly secured to the case 10 via its ends 35, engaged in grooves 36 arranged in the large side panels 14, 15. The anvil 33 is separated from the other branch of the conductor 25 by an air-gap 34 and the metal block is laminated to limit the Foucault currents generated in the block 33. It can be understood that when the contact bridge 13 closes, the movable contact 32 strikes the stationary contact 29 and the impact is transmitted to the anvil 33 which prevents any bouncing of the stationary contact 29 and amplifies the blow struck on the stationary contact 29. This blow causes crushing of the surfaces in contact and a reduction of the contact resistance, which does not present any dispersion. The metal block 33 is made of ferromagnetic material increasing the magnetic field generated by the current flow in the input conductor 25, for arc blowout in the direction of the extinguishing chamber. The air-gap 34 prevents any short-circuiting of the half-loop but it is clear that an additional insulation can be provided.

The air-gap 34 is smaller than the thickness of the anvil 33.

Figure 5:
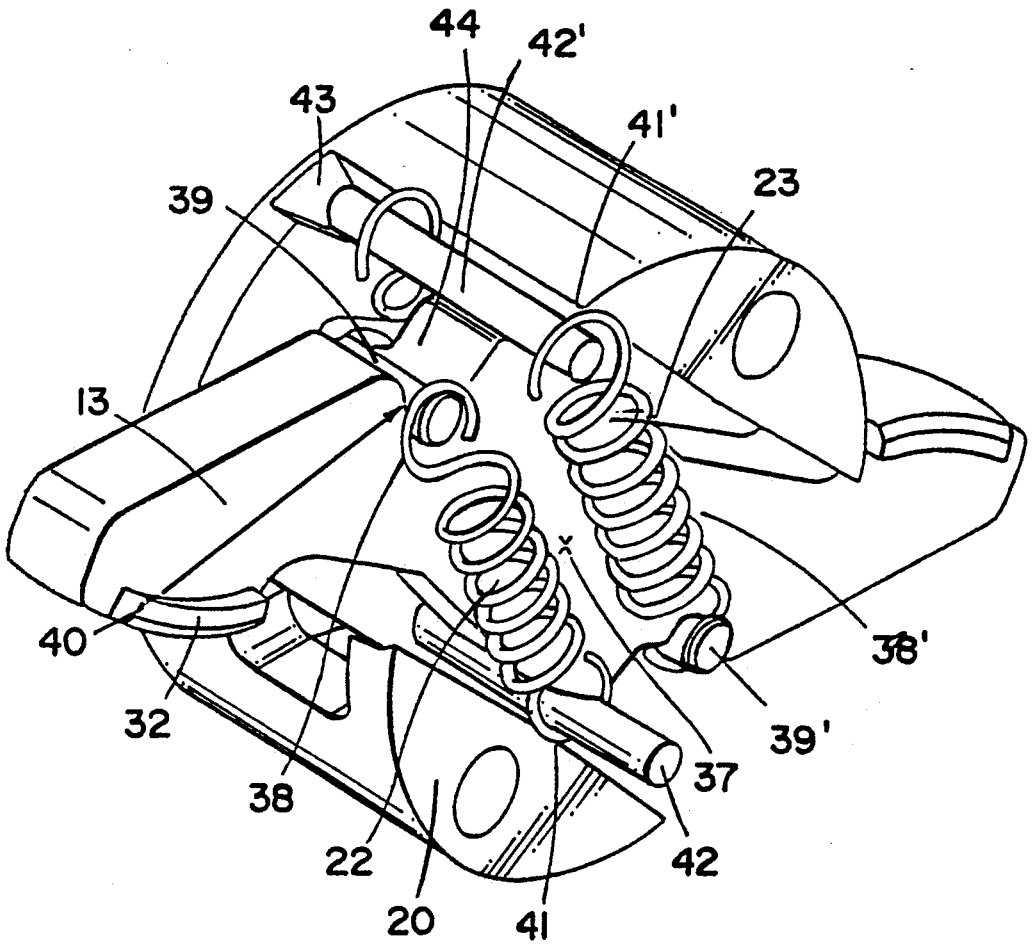
FIG. 5 is a detailed perspective view showing the movable contact bridge and the operating bar.

Referring more particularly to FIG. 5, it can be seen that the springs of the pairs of springs 22, 23 are arranged symmetrically on each side of the contact bridge 13, framing the latter. Furthermore, the two pairs of springs 22, 23 are arranged symmetrically with respect to the dummy axis 37 of rotation of the contact bridge 13. One 38 of the ends of the springs 22 is anchored on a spindle 39 extending parallel to the dummy axis 37 and taking its bearing in a notch 40 arranged on the face of the contact bridge 13 opposite from the one bearing the movable contact 32. The other end 41 of the tension springs 22 is anchored on a rod 42 slidingly mounted in a notch 43 arranged in the bar 20. The tension springs 22 urge the rod 42 towards the bottom of the notches 43 and exert via the spindle 39 a torque on the contact bridge 13 tending to make the latter pivot in the closing direction. The springs 23 are arranged in the same way, and the same reference numbers assigned with an index are used to designate the corresponding parts. The two pairs of springs 22, 23 ensure floating mounting of the contact bridge 13 in the orifice 21 allowing rotation of the contact bridge 13 around the dummy axis 37. A floating mounting of this kind is described in French Patent no. 2,622,347. The pairs of springs 22, 23 also provide the contact pressure in the closed position of the pole. The pairs of springs 22, 23 are arranged symmetrically with respect to the dummy axis of rotation 37, in such a way as to exert in any position of the contact bridge 13, a return torque of the contact bridge to the closed position. This torque decreases as the contact bridge 13 moves towards the open position, and the anchoring rods 42, 42' are arranged in such a way as to interfere with the pivoting trajectory of the contact bridge 13, at the end of opening travel by repulsion of the contact bridge 13. To achieve this, the edges of the contact bridge 13 bear or are shaped as cam surfaces 44, 44' engaging at the end of repulsion travel respectively the rods 42, 42', making them slide in their notch 43, in the elongation direction of the springs 22, 23. This engagement slows down the movement of the contact bridge 13, and reduces or cancels the impact on the end of opening travel stop, for example formed or arranged on the case 10. The shape of the cams 44, 44' is naturally determined to obtain progressive deceleration of the contact bridge 13 and it can be arranged to preserve in all positions a return torque of the contact bridge to the closed position, or inversely present a ratchet retaining the contact bridge 13, in the repelled open position. In the former case, the contact bridge 13 recloses automatically if opening of the circuit breaker is not confirmed by rotation of the bar section 20 actuated by the mechanism, but the to-and-fro travel of the contact bridge 13 is slowed down by its braking at end of travel. This slowing-down can be sufficient to provide tripping selectivities, i.e. opening of a load-side switchgear device which clears the fault. In the latter case of retention of the contact bridge 13 in the repelled position, this ratcheting is suppressed when rotation of the bar section 20 takes place, actuated by the mechanism, so as to bring the contact bridge 13 back to the initial position with respect to the bar 20. It can easily be seen that the braking and/or retaining system of the contact bridge 13 in the repelled position does not require any additional parts, and is particularly simple and efficient.

The invention is naturally in no way limited to the embodiment more particularly described herein.

We claim:

1. A low-voltage limiting circuit breaker having an outer case, comprising:

a rotary contact bridge;

a pair of stationary contacts cooperating with said contact bridge;

a conductor for current input to each of said stationary contacts, each conductor extending in the plane of movement of said contact bridge and shaped as a half-loop having a first and a second parallel strand spaced apart, the first strand bearing a stationary contact part;

a bar having a transverse opening, a central part of the contract bridge being located in said transverse opening, said contact bridge being rotatably mounted with respect to said bar toward an opening direction; and a rigid metal block inserted between the first and second strands of each conductor, said rigid metal block being adjoined to the first strand opposite from the stationary contact part, wherein an air-gap is formed between the rigid metal block and the second strand, portions of the metal block extending into grooves provided in side walls of the outer case so as to rigidly secure the rigid metal block to the outer case and prevent movement therebetween, the rigid metal block being made of ferromagntic material to strengthen a magnetic field for arc blowout.

2. The circuit breaker according to claim 1, wherein said outer case is a narrow parallelipidedic single-pole insulating case, said circuit breaker further comprising an extinguishing chamber to extinguish arcs formed between the stationary contacts and said contact bridge, each conductor extending inside the outer case and being supported therein respectively by a base plate and a top plate of the outer case.

3. The circuit breaker according to claim 1, wherein said rigid metal block is laminated to oppose Foucault currents generated therein.

4. The circuit breaker according to claim 1, wherein the air-gap is smaller than the thickness of the anvil.

* * * * *